United States Patent [19]

McGill

[11] 4,406,110

[45] Sep. 27, 1983

[54] POWER CYLINDER HAVING EXTERNAL STROKE ADJUSTMENT MECHANISM

[75] Inventor: Robert W. McGill, Munroe Falls, Ohio

[73] Assignee: A-T-O Inc. (now Figgie International), Ohio

[21] Appl. No.: 189,707

[22] Filed: Oct. 1, 1980

[51] Int. Cl.[3] ..... F15B 15/22; B65B 5/6; B65B 21/14

[52] U.S. Cl. ..... 53/249; 91/405; 91/444

[58] Field of Search ..... 91/404, 405, 406, 407; 53/249

[56] References Cited

U.S. PATENT DOCUMENTS

| | | | |
|---|---|---|---|
| 2,114,334 | 4/1938 | Conklin | 91/406 |
| 2,606,414 | 8/1952 | Dyrr | 91/404 |
| 2,606,532 | 8/1952 | Ziskol | 91/404 |
| 2,939,427 | 6/1960 | Peros | 91/404 |
| 3,015,309 | 1/1962 | Austin | 91/407 |

*Primary Examiner*—Paul E. Maslousky

*Attorney, Agent, or Firm*—Oldham, Oldham, Hudak, Weber & Sand Co.

[57] ABSTRACT

The stroke of an air driven power cylinder is controlled through a load means attached to the piston rod, a control valve means connected to the cylinder to control air exhaust from the cylinder on the extension stroke of the piston, and an external cushion valve means operably connects to the control valve means and the load means for air exhaust flow therethrough in a controlled manner but for shut-off of the air exhaust as the piston approaches the end of its stroke to trap some air in the cylinder before the piston stroke ends, the cushion valve means having a member therein of adjustable position for control of the length of stroke of the piston.

6 Claims, 7 Drawing Figures

POWER CYLINDER HAVING EXTERNAL STROKE ADJUSTMENT MECHANISM

TECHNICAL FIELD

The invention herein resides in the art of air driven power cylinders and more particularly, to the improvement for such cylinders of an external stroke adjustment mechanism.

BACKGROUND ART

Heretofore there have been many approaches to the control of the stroke of the piston in air driven power cylinders and many of these prior constructions have involved various types of air cushioning action obtained inside the cylinder as it approaches the end of a power stroke. Some efforts have been made to provide internal controls for adjusting the length of stroke of a piston in a power cylinder and some prior apparatus is shown in U.S. Pat. Nos. 2,614,536 and 2,922,397 on auxiliary piston means inside the cylinder unit to control the length of stroke of the piston. However, these prior constructions are relatively complex and expensive and do not have maximum life and freedom from maintenance requirements.

One particular use of an adjustable stroke air cylinder is in the packaging of articles, particularly the packing of a plurality or group of bottles in a case-filling machine wherein the bottles are arranged in a group for case-filling action such as by the mechanism shown in U.S. Pat. No. 3,052,071, after which grouping of the articles, they are dropped down through a grid in the apparatus to be received into an empty container or case positioned below the case-filling area of the machine. Usually an empty case is fed to a case-lifter mechanism that receives the case, lifts it up to a position adjacent to the case-filling grid that drops articles down into the case, and then the case-lifter drops the filled case down for other processing. In an apparatus of this type, the case-lifting means have been of various types, including the construction shown in reissue U.S. Pat. No. 26,906. While these case-lifter means have been operative and give good service for some time, it obviously is desirable to have an improved, easily adjustable case-lifter device available. An adjustable length stroke cylinder for controlled power lift drive actions can find a number of different uses in the marketplace, including those in case-filling actions.

DISCLOSURE OF INVENTION

The general object of the present invention is to provide an improved mechanism for varying and controlling the length of stroke of a piston in an air-driven power cylinder.

Another object of the invention is to provide an adjustable length stroke power cylinder which has an air-cushioning means provided externally of the cylinder and also has an air-cushioning means and action internally of the cylinder to facilitate obtaining a smooth, cushioned end of the power stroke of the piston in the cylinder.

Another object ofthe invention is to provide an external control assembly in association with a power cylinder, and to provide a member adjustable longitudinally of the cylinder in the control assembly to correlate the position of such adjustable member with the length of stroke of piston in the power cylinder.

Another object of the invention is to provide a control unit integral with a load support plate and providing an air-cushion means in association with such auxiliary device to control air exhaust flow from the power cylinder on the power stroke of the cylinder.

Another object of the invention is to provide air-flow control means in the exhaust line from the power cylinder for limiting the speed of flow of the compressed air being exhausted from the cylinder; to provide any known type of valve means and associated devices for restricted exhaust air-flow from the cylinder; and to provide an external air-cushion means for operative association with internal air-cushioning means in the cylinder to obtain an improved, positive acting control for smooth motion termination of the piston on its power stroke.

The foregoing and other objects and advantages of the invention which will be made more apparent as the specification proceeds are achieved by a mechanism for varying and/or controlling the length of stroke of an air driven power cylinder including a piston and a piston rod and which mechanism comprises a load means attached to the piston rod to be moved thereby, a control rod on the load means and positioned externally of the power cylinder but parallel to the piston thereof, a control valve means and assembly connected to the cylinder to control air exhaust therefrom on the extension stroke of the piston, and a cushion valve means operably connected to the control valve means and to the control rod of air exhaust flow through such cushion valve means but for shut off of such exhaust flow as the piston approaches the end of its powered extension stroke.

BRIEF DESCRIPTION OF DRAWINGS

When referring to corresponding means shown in the drawing and referred to in the specification, corresponding numerals are utilized.

BEST MODE FOR CARRYING OUT THE INVENTION

Figure 1:
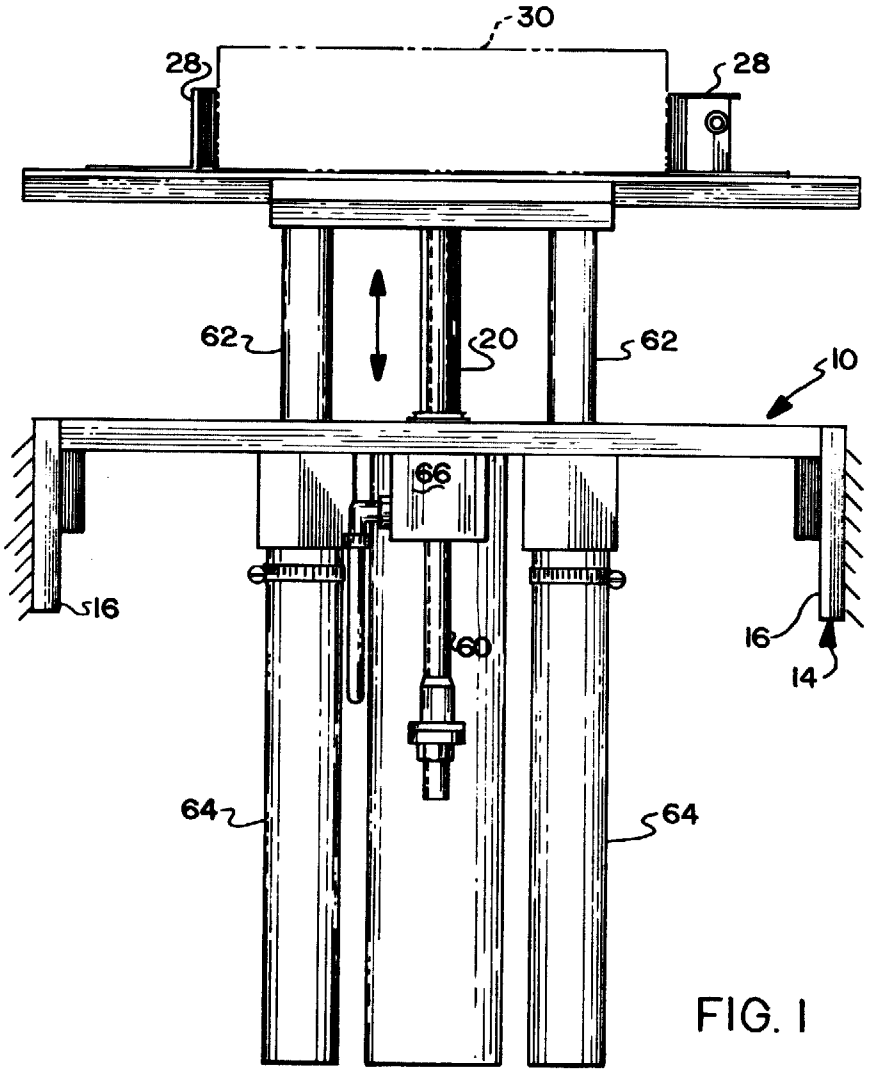
FIG. 1 is a front elevation of a mechanism for varying the length of stroke of a fixed power cylinder showing it in association with portions of an operative apparatus.

Regarding the details of the structure shown in the accompanying drawings, a mechanism 10 is shown which mechanism generally refers to the apparatus for controlling and cushioning the stroke of an air-driven power cylinder 12. This air cylinder 12 is shown in fixed engagement with a frame 14 having any suitable construction and including side plates 16 as shown in the drawings. The air cylinder 12 has a piston 18 therein, a piston rod 20 being suitably secured to the piston and extending from the cylinder. This air cylinder 12 normally is positioned on a vertical axis and the piston rod 20 extends up to and is secured to a load support plate 22. Such plate 22 positions a carrier plate 24 of greater dimensions thereon by a resilient cushioning member or a slab 26 between it and the plate 24. Centering and/or aligning members 28 usually are provided on this carrier plate 24 in opposed spaced relationship to enable a conventional external member such as means 30 broadly shown in FIG. 1 to provide an unloaded case to the carrier plate 24 as by sliding an opened empty case onto this plate 24 in suitably controlled timed relation to the other operations in the apparatus.

As previously indicated, the mechanism of the invention, is adapted to be used with article packing apparatus to be located at the article case-filler area thereof. The number 34 broadly indicated grid guide fingers and associated means used for assembling a group of articles, such as bottles, into a case-filling grouping and then for dropping them down into a case on the carrier plate 24 as is well known in the trade as evidenced by the construction shown in U.S. Pat. No. 3,052,071.

DIAGRAMMATIC AIF-FLOW

Figure 5:
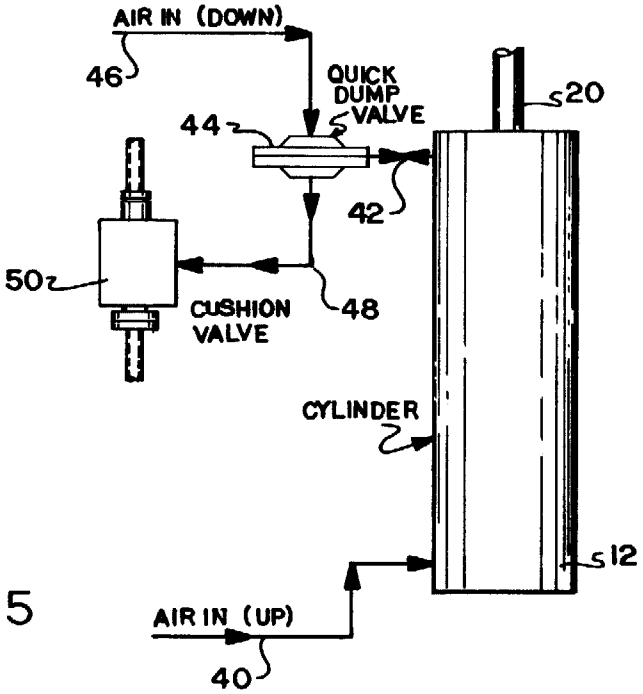
FIG. 5 is a diagrammatic view of the air-flow to and from the air powered cylinder used in the mechanism of the invention.
Figure 4:
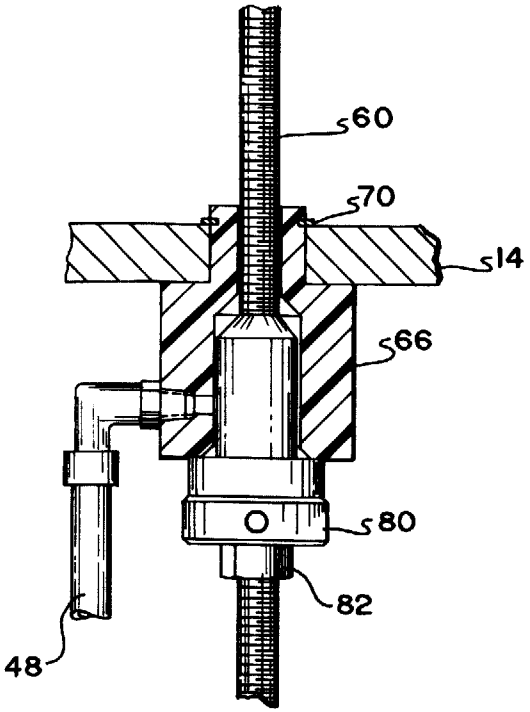
FIG. 4 is a vertical section, like FIG. 3, but showing the air-cushion valve means in its air exhaust termination position.
Figure 3:
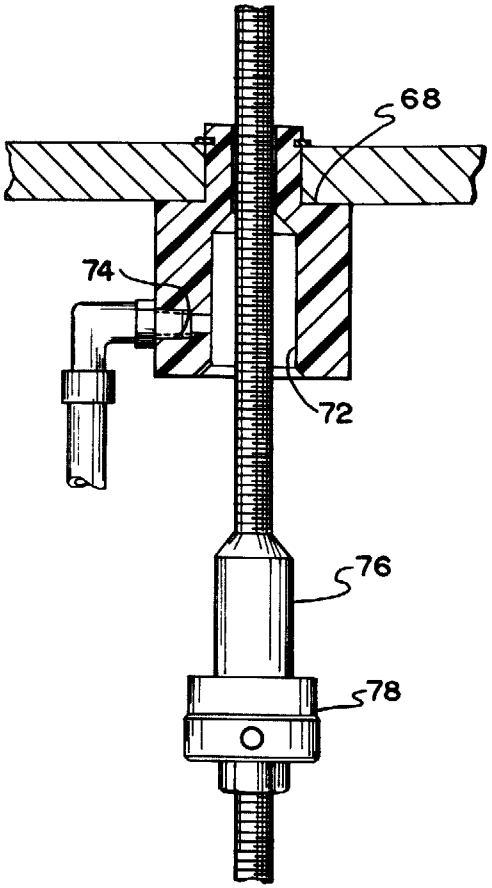
FIG. 3 is an enlarged fragmentary vertical section of an external air-cushion valve means in the apparatus and means associated therewith.

FIG. 5 shows that the double action cylinder 12 has an air pressure supply line 40 connected to its closed end to drive the piston away from this closed end of the cylinder and provide the operative power stroke of the piston rod 20 and means associated therewith. When such piston rod 20 is being moved upwardly on its operative or extension stroke, obviously the air received in this cylinder 12 for forcing the piston and piston rod 20 down on its retraction stroke must be exhausted therefrom. Hence, a line 42 connects to the opposite or open end of the air cylinder and it in turn connects to a conventional quick dump diaphragm valve 44 while an air supply line 46 connects to the valve for air pressure supply to the valve and flow through the air-line 42 to the cylinder for forcing the piston therein downwardly for its retraction stroke. However, when air is to be exhausted from the cylinder 12, then the valve 44 connects the exhaust air flow from line 42 to line 48 and air discharge control cushion valve assembly 50 rather than to the atomosphere. This cushion valve assembly or means 50 is shown in more detail in FIG. 3 and 4 but the air-flow and control system of the invention includes any suitable means for dampening or restricting air exhaust from the cylinder 12 so that some air remains in the cylinder as the piston 18 is moved toward the end of its power stroke. At such time the cushion valve 50 will seal off air exhaust therethrough and this occurs when some air still remains in the cylinder to trap such air therein and build up an air cushion volume in the cylinder. Such air aids in the dampening of movement of the piston 18 and associated means to absorb the major portion of inertia of the piston rod, load support plate 22 carrier plate 24 and load means thereon as they approach the end of the upward power stroke of the air cylinder 12. But, this cushioning action obtained internally of the air cylinder is aided and improved by the cushion action obtained externally of the cylinder by the valve assembly 50.

Another feature of the apparatus of the invention is a part positioned externally of the cylinder and which relates to adjustment of the length of stroke of the piston 18 in the cylinder 12. This permits adjustment of the length of the article drop obtained in the apparatus of FIG. 2 in relation to the size of the articles being packaged.

EXTERNAL AIR CUSHION MEANS MEANS AND STROKE ADJUSTMENT

Figure 2:
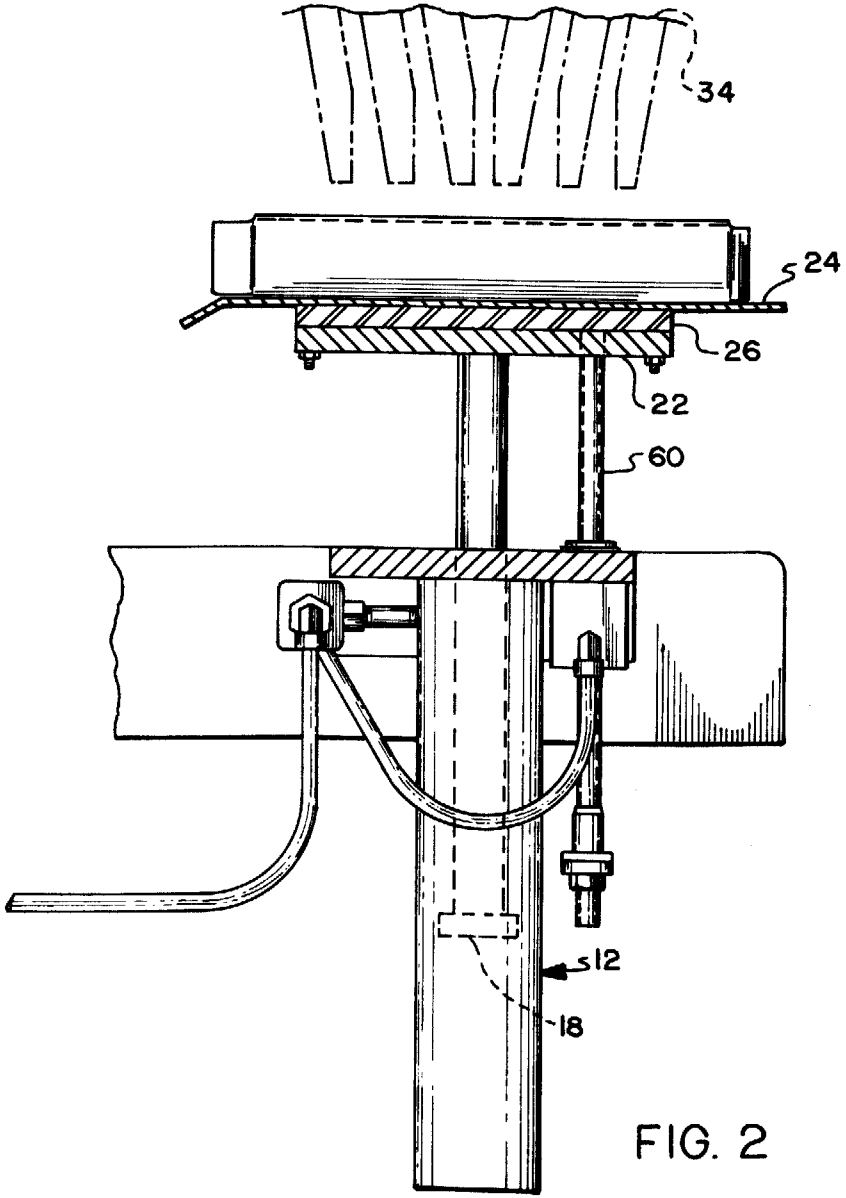
FIG. 2 is a side elevation of the apparatus of FIG. 1; with parts of the apparatus being shown in vertical section.

In FIG. 2, as well as in other figures in the drawings, a control rod 60 is shown secured to the load support plate 22 and this control road is threaded and is positioned externally of the air cylinder 12 with the rod being parallel to the piston rod 20. Usually a pair of guide rods 62 also are secured to this load support plate 22 and are received in suitable guide tubes 64 that extend downwardly from the frame. The frame 14 also has a valve block 66 secured thereto in any suitable manner as by a shoulder 68 on the block seating against an under surface on a frame plate and with a suitable lock washer 70 engaging the upper end of this valve block that extends through the frame plate.

The valve block 66 has a center bore 72 that has a laterally extending exhaust bore 74 formed in the wall thereof. This exhaust bore connects to the air-flow line 48, extending from the control valve 44 to receive air exhausted from the air cylinder 12 on the extension stroke of the piston. Hence, air will exhaust through this line 48 and bore 74 until a seal sleeve 76 in operative engagement with the control rod 60 moves vertically up into the bore to restrict or dampen air exhaust from bore 74 by relatively snug engagement of this seal section or sleeve in the bore 72. The seal sleeve unit or assembly 76 also has a resilient slightly compressable cushioning or sealing washer 78 provided on the sleeve 76 at its lower end and retained in position as by suitable locknut or flange 80 on the lower end portion of the seal sleeve assembly 76. A locknut 82 or similar means is engaged with the control rod 60 and with the seal sleeve assembly to retain it in a given position on the control rod. But the seal sleeve assembly 76 is adjustable longitudinally of this control rod 60 and can be retained thereon in any desired position to correlate and control the effective operative stroke of the piston 18 in its cylinder 12. The rod 60 usually is threaded and the seal sleeve 76 has a tapped bore to permit adjustment of the seal sleeve to desired location on the control rod to restrict air exhaust as the seal sleeve is moved up past the bore and for full seal of the bore 64. Then the trapped air in the cylinder 12, aided by a slight compressive force of the washer 78, will cushion the end of the piston movement. An external control will then turn air pressure back out of the air line 46 to force the piston 18 to retract.

Figure 6B:
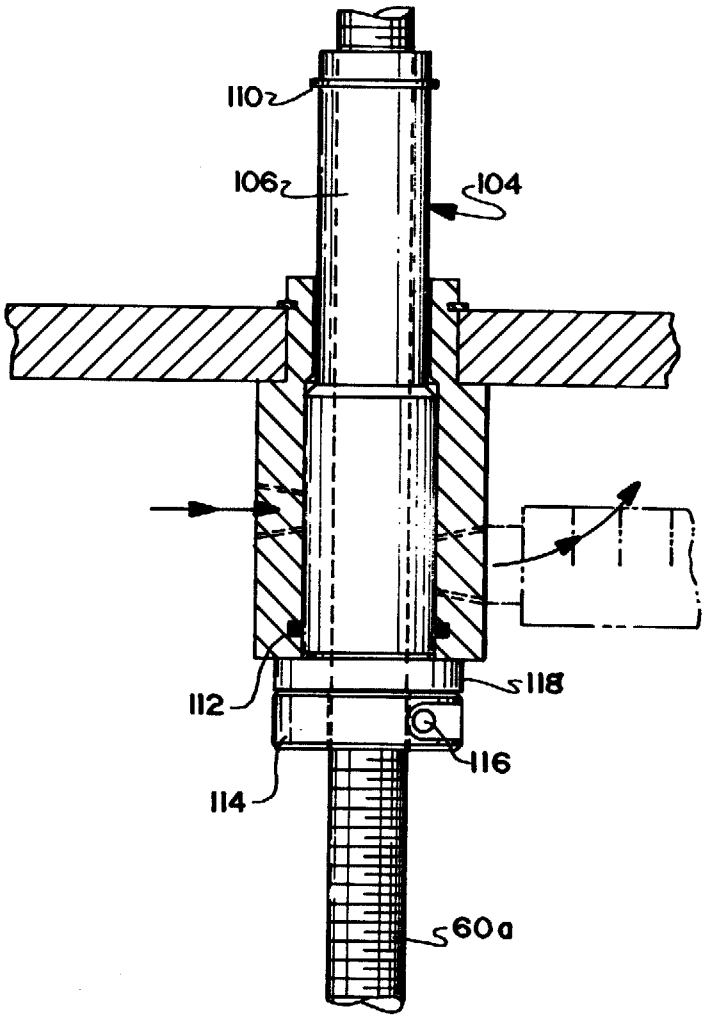
FIG. 6B is a section like FIG. 6A of the means in a closed position.
Figure 6A:
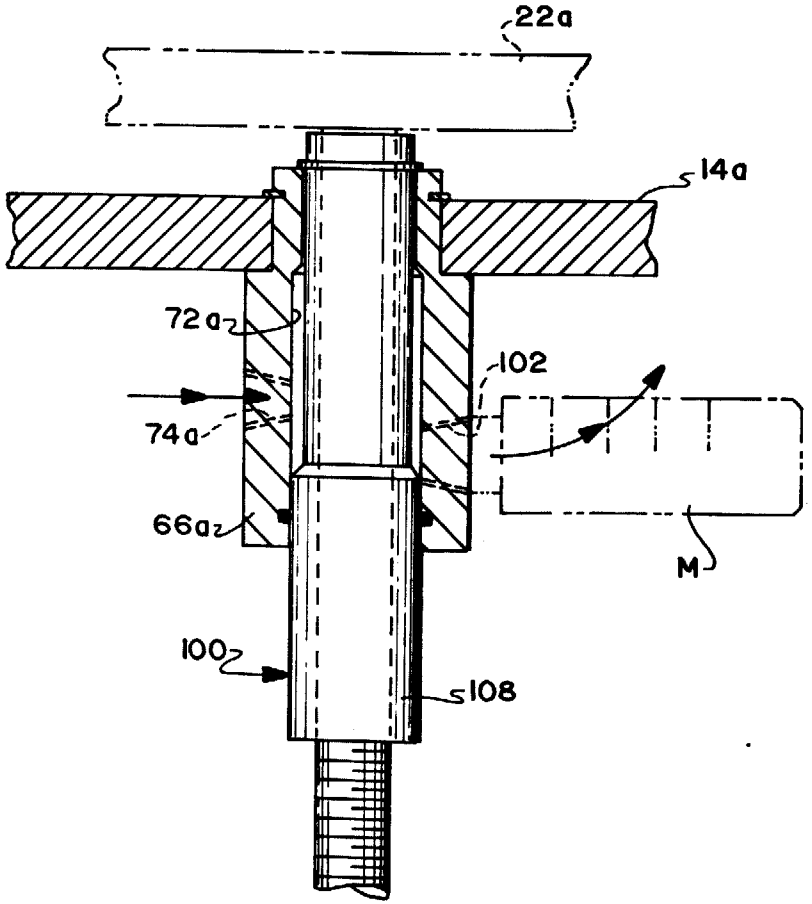
FIG. 6A is a partial vertical section of an air cushion valve and seal means in its lowered position.

Reference is now made to the modification of the seal means shown in FIGS. 6A and 6B. In this instance the air cushion valve means and/or the modified seal means 100 will operate with lower noise levels than the seal means shown in the other FIGS. of the drawings. Specifically, the seal means 100, includes a valve block **66*a*, affixed to frame 14*a*, which has a center bore 72*a* with a control rod 60*a* extending through such center bore. The valve block 66*a* has an inlet bore 74*a* provided in a wall thereof, while an outlet bore 102 of any suitable size is formed in the valve block wall generally diametrically opposed to the inlet bore 74*a*; a muffler M connects to this bore 102**.

In order to control or guide air flow to the valve block **66*a* and release it smoothly therefrom, the seal means 100 includes a spool device 104 that has an upper section 106 of a noticeably smaller diameter than the center bore 72*a*, and the lower section 108 is of a diameter to be snuggly received in such center bore to substantially seal the same and greatly restrict or terminate air flow through the center bore from the inlet bore 72***a* to the outlet bore 102. The upper spool section 104 has a lock washer 110, or equivalent, thereon, to prevent downward movement of the spool to any position below that shown in FIG. 6A, to which it is moved by load plate 22*a*. The spool device does have a larger center bore than the outer diameter of the control rod 60*a* to be slidably positioned thereon. The valve block 66*a* also has a suitable friction ring or device 112 positioned in its lower end to retain the spool in a given position and to aid in a seal action of the center bore. Air flow exhaust is retarded to the open sleeve air flow space around the spool section 106 when in the position of FIG. 6A. The air flow sleeve may comprise about a ⅛" thick sleeve around a spool section of for example, 1" O. D.

This spool device 104 is raised by a split collar 114 that preferably has a tapped bore engaging the control rod 60*a* and is adjustable longitudinally thereof. A lock screw 116 is engaged with the split collar 114 to retain it in good operative engagement with the control rod. In order to cushion engagement action between the collar 114 and the spool, a suitable cushioning washer 118 is carried by the upper surface of this collar 114 and it will abut and seal against the lower end of the valve block 66*a* when the control rod 60*a* has been moved to its uppermost position. An air cushion valve block 66*a* when the control rod 60*a* has been moved to its uppermost position. An air cushion valve is formed to shut off air exhaust and to aid in the smooth termination of the piston stroke.

It should be appreciated that the mechanism of the invention does not have to be used in a vertical axis position for the piston rod 20 at all time, but the description of the invention is made to refer to the apparatus being so positioned. Of course, the piston 12 and associated means could be pivotally positioned, if desired, and have pivotal and axial movement. In all events, the control rod 60 and 60*a* and the length of axial movement permitted thereby will limit and control the operative stroke of the piston rod 20 in its operative cylinder. An accurate external adjustment, for the piston stroke is provided by the apparatus of the invention.

The apparatus of the invention is positive in action, dependable, and relatively inexpensive. But a good external control has been provided by the invention for the stroke length of a piston. Hence, the objects of the invention have been achieved.

While one complete embodiment of the invention has been disclosed herein, it will be appreciated that modification of this particular embodiment of the invention may be resorted to without departing from the scope of the invention.

What is claimed is:

1. A mechanism for varying the stroke of an air driven, power cylinder having a piston and a piston rod, and comprising a load means attached to said piston rod for movement thereby, a control rod on said load means positioned externally of said power cylinder but parallel to said piston rod.

a control valve means connected to said cylinder to control air exhaust therefrom on the extension stoke of said piston, a cushion valve means operably connected to said control valve means and said control rod for air exhaust flow therethrough but for shut off of such flow as said piston approaches the end of its extension stroke, said cushion valve means including a member carried by said control rod, said control rod forming a rigid movable unit with said piston rod, and said cushion valve means also including a valve block means secured in fixed relation to said power cylinder, and said member carried by said control rod is a seal means that is adjustable longitudinally on said control rod and is movable into engagement with said valve block means by extension power stroke movement of said piston to reduce the speed of exhaust of air from said power cylinder and the speed of the stroke of the power cylinder.

2. A mechanism, as in claim 1, where said valve block means has a recess therein and is operably connected to said control valve means for air exhaust therefrom on the extension stroke of said piston, said control rod being threaded and said seal means includes a sleeve section sized for insertion into said recess in said valve block means to restrict air discharge therefrom when moved into said recess, said sleeve being movable longitudinally of said control rod, and a seal device associated with said sleeve section to seal against said valve block means at the end portion of said piston extension stroke.

3. A mechanism, as in claim 1, wherein said valve block means has a center bore and inlet and outlet bores connected to such center bore, and said cushion valve means includes a spool having unitary upper and lower sections slidably carried on said control rod, said lower section substantially sealing and said upper section permitting air flow from said inlet bore to said outlet bore when engaged with said center bore, said control rod extending through said center bore of said valve block.

4. A mechanism, as in claim 3, and including a positioning member on the lower end of said control rod and adjustable longitudinally thereof, on end of said spool engaging said positioning member for movement towards said valve block means, said spool continually engaging said valve block but only sealing air flow therethrough when said pool is moved up for full engagement of said lower section with said valve block means.

5. An article packing apparatus, including means for supply of empty cases to a case-filler area and means to supply units of grouped articles to such area for gravity deposit into one of said cases, a fixed, air driven, power cylinder having a piston and a piston rod, and a mechanism for varying the stroke of said power cylinder, which mechanism comprises a load support attached to said piston rod for movement thereby, said power cylinder being positioned on a vertical axis at said case filler area, a control rod on said load support positioned externally of said power cylinder but parallel to said piston rod and retained in a fixed position in relation thereto, a control valve means connected to said cylinder to control air discharge therefrom on the extension lift stroke of said piston, said load support receiving an empty case thereon at said case filler area, a cushion valve means operably connected to said control valve means and said control rod for air exhaust therethrough but for shut off of such exhaust as said piston approaches the end of its extension stroke and positions said one case for receipt of a unit of said grouped articles, and said cushion valve means includes a valve body block, said valve block being stationary and a seal means adjustably engaging said control rod for movement longitudinally thereof, said seal means being movable into engagement with said valve body block by extension stroke movement of said piston rod to terminate exhaust of air from said power cylinder and control the speed of stroke of said piston.

6. A mechanism, as in claim 5 where said valve block has a bore therein operably connected to said control valve means for air exhaust therefrom on the extension stroke of said piston, and said seal means includes a sleeve section sized for insertion into said bore in said valve block to restrict air discharge therefrom when moved into said bore, and a seal device associated with said sleeve section to seal against said valve block at the end portion of said piston extension stroke.

* * * * *